US010920664B2

(12) United States Patent
Maekawa et al.

(10) Patent No.: US 10,920,664 B2
(45) Date of Patent: Feb. 16, 2021

(54) OUTBOARD MOTOR

(71) Applicant: YAMAHA HATSUDOKI KABUSHIKI KAISHA, Iwata (JP)

(72) Inventors: Shinya Maekawa, Iwata (JP); Makoto Morino, Iwata (JP); Koichi Nakayama, Iwata (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 30 days.

(21) Appl. No.: 16/579,233

(22) Filed: Sep. 23, 2019

(65) Prior Publication Data

US 2020/0200075 A1 Jun. 25, 2020

(30) Foreign Application Priority Data

Dec. 20, 2018 (JP) ..... JP2018-237985

(51) Int. Cl.

| | |
|---|---|
| ***F02B 61/04*** | (2006.01) |
| ***B63H 20/24*** | (2006.01) |
| ***B63H 20/14*** | (2006.01) |
| ***F02M 35/16*** | (2006.01) |

(52) U.S. Cl.

CPC ..... *F02B 61/045* (2013.01); *B63H 20/14* (2013.01); *B63H 20/245* (2013.01); *F02M 35/167* (2013.01)

(58) Field of Classification Search

CPC ..... B63H 20/14; B63H 20/245; F02B 61/045; F02M 35/167

See application file for complete search history.

(56) References Cited

U.S. PATENT DOCUMENTS

| | | | | | |
|---|---|---|---|---|---|
| 4,909,226 | A | * | 3/1990 | Nakahama | F02B 75/20 123/198 C |
| 5,197,436 | A | * | 3/1993 | Ozawa | F02B 75/22 123/456 |
| 5,450,831 | A | * | 9/1995 | Fukuoka | F02B 61/045 123/509 |
| 5,603,303 | A | * | 2/1997 | Okajima | F01L 1/053 123/508 |
| 5,855,197 | A | * | 1/1999 | Kato | F02B 61/045 123/509 |
| 5,890,472 | A | * | 4/1999 | Saito | F02M 37/20 123/516 |
| 5,915,363 | A | * | 6/1999 | Iwata | F02B 61/045 123/497 |
| 5,941,205 | A | * | 8/1999 | Hiraoka | F02B 61/045 123/184.35 |

(Continued)

FOREIGN PATENT DOCUMENTS

| | | | |
|---|---|---|---|
| JP | 2000-110686 A | | 4/2000 |
| JP | 2000110686 | * | 4/2000 |

*Primary Examiner* — S. Joseph Morano
*Assistant Examiner* — Jovon E Hayes
(74) *Attorney, Agent, or Firm* — Global IP Counselors, LLP

(57) ABSTRACT

An intake manifold is connected to a cylinder of an engine, and extends backward from the cylinder. A throttle body is attached to the intake manifold. As seen in a plan view of an outboard motor, the throttle body is disposed backward of a head cover, while being disposed inward of a lateral end of the intake manifold in a right-and-left direction of the outboard motor.

7 Claims, 9 Drawing Sheets

(56) References Cited

U.S. PATENT DOCUMENTS 5,943,996 A * 8/1999 Sogawa ..... F02B 61/045 123/509
5,992,392 A * 11/1999 Saito ..... F02B 61/045 123/508
6,032,638 A * 3/2000 Kato ..... F02B 17/005 123/295
6,070,564 A * 6/2000 Hiraoka ..... F02B 61/045 123/195 P
6,082,336 A * 7/2000 Takahashi ..... F01L 1/0532 123/508
6,112,726 A * 9/2000 Saito ..... F02B 75/22 123/509
6,148,787 A * 11/2000 Takano ..... F01L 1/46 123/195 A
6,159,063 A * 12/2000 Fujii ..... F02B 61/045 123/508
6,295,956 B1 * 10/2001 Kato ..... F02B 75/22 123/41.82 R
6,390,071 B1 * 5/2002 Nakai ..... F02B 75/20 123/509
6,446,599 B1 * 9/2002 Nakayasu ..... F02D 31/005 123/339.23
6,478,005 B2 * 11/2002 Tsubouchi ..... B63H 20/36 123/195 A
6,575,145 B2 * 6/2003 Takahashi ..... F02M 69/462 123/519
6,763,795 B2 * 7/2004 Takahashi ..... F02M 63/0295 123/195 P
6,912,996 B2 * 7/2005 Kato ..... F02B 61/045 123/469
6,971,374 B2 * 12/2005 Saito ..... F02D 9/02 123/516
7,013,878 B1 * 3/2006 Cotton ..... F02M 37/20 123/41.31
7,117,857 B2 * 10/2006 Saito ..... F02M 37/20 123/516
7,832,380 B1 * 11/2010 Abou Zeid ..... F02M 37/14 123/519
9,683,487 B2 * 6/2017 Miyagi ..... F02F 7/0012
10,233,792 B2 * 3/2019 Whiston ..... F01L 1/0532
10,240,538 B2 * 3/2019 Noma ..... F02B 61/045
2002/0062819 A1 * 5/2002 Takahashi ..... F02M 69/462 123/519
2002/0072281 A1 * 6/2002 Takahashi ..... F02M 63/0295 440/88 F
2004/0203299 A1 * 10/2004 Kashima ..... F02B 75/22 440/88 A
2007/0240686 A1 * 10/2007 Kamito ..... F02B 61/045 123/509
2007/0243778 A1 * 10/2007 Kamito ..... F02M 37/20 440/88 F
2017/0107888 A1 * 4/2017 Muramatsu ..... F01N 13/008
2020/0198746 A1 * 6/2020 Nakayama ..... B63H 20/001
2020/0200075 A1 * 6/2020 Maekawa ..... B63H 20/14
2020/0200076 A1 * 6/2020 Maekawa ..... B63H 20/32

* cited by examiner

OUTBOARD MOTOR

BACKGROUND

Technical Field

The present invention generally relates to an outboard motor.

Background Information

An intake manifold is connected to an engine of an outboard motor. A throttle body is attached to the intake manifold. For example, Japan Laid-open Patent Application Publication No. 2000-110686 describes an outboard motor in which a pair of intake manifolds extends forward from a pair of cylinder heads of an engine, respectively. A throttle body is attached to the pair of intake manifolds, and is disposed in front of the engine.

SUMMARY

As described above, when the outboard motor has the structure in which the intake manifolds extend forward from the cylinder heads, respectively, while the throttle body is disposed in front of the engine, the front part of the outboard motor is configured to have a large size. Incidentally, the outboard motor is attached to a vessel body of a watercraft, and the vessel body is disposed in front of the outboard motor. Because of this configuration, the front part of the outboard motor, when having a large size, is likely to interfere with the vessel body of the watercraft in tilting up the outboard motor.

The front part of the outboard motor, even when having a large size, can be inhibited from interfering with the vessel body of the watercraft with use of a layout of the outboard motor set oil (displaced) backward from the vessel body. In this case, however, it is required to strengthen a structure for attaching the outboard motor to the vessel body. This results in increase in weight of the outboard motor.

One object of the present disclosure is to prevent interference between the front part of the outboard motor and the vessel bods of the watercraft in tilting up the outboard motor, and simultaneously inhibit increase in weight of the outboard motor.

An outboard motor according to an aspect of the present disclosure includes an engine, a driveshaft, a propeller shaft, an intake manifold and a throttle body. The engine includes a crankcase, a crankshaft, a cylinder and a head cover. The crankshaft is at least in part disposed inside the crankcase. The cylinder is disposed behind the crankcase. The head cover is disposed behind the cylinder. The driveshaft is connected to the crankshaft, and extends in an up-and-down direction or the outboard motor. The propeller shaft is connected to the driveshaft, and extends in a back-and-forth direction of the outboard motor. The intake manifold is connected to the cylinder, and extends backward from the cylinder. The throttle body is attached to the intake manifold. The throttle body is disposed backward of the head cover as seen in a plan view of the outboard motor, while being disposed inward of a lateral end of the intake manifold in a right-and-left direction of the outboard motor.

In the outboard motor according to the present aspect, the intake manifold extends backward from the cylinder, while the throttle body is disposed backward of the head cover. Because of this, the outboard motor can be made more compact in size of the front part thereof than when the throttle body is disposed in front of the engine. Consequently, it is possible to prevent interference between the front part of the outboard motor and a vessel body of a watercraft in tilting up the outboard motor. Furthermore, the outboard motor is not required to be set off (displaced) backward so as to prevent interference between the front part thereof and the vessel body of the watercraft. Hence, increase in weight of the outboard motor can be inhibited.

DETAILED DESCRIPTION OF EMBODIMENTS

Figure 1:
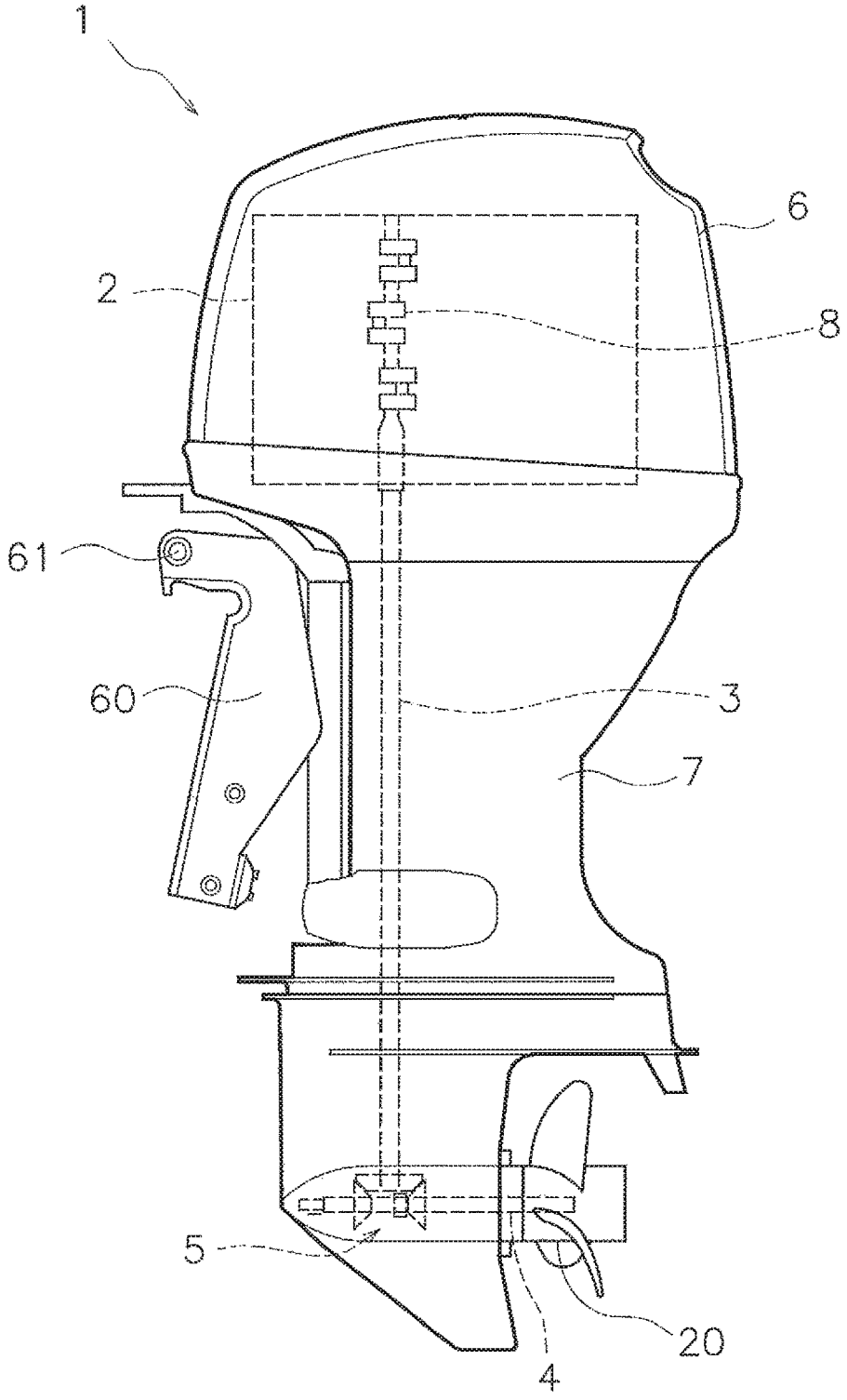
FIG. 1 is a side elevational view of an outboard motor according to an embodiment.

An embodiment will be hereinafter explained with reference to drawings. FIG. 1 is a side view of an outboard motor 1 according to the embodiment. As shown in FIG. 1, the outboard motor 1 includes an engine 2, a driveshaft 3, a propeller shaft 4, a shift mechanism 5, an engine cowl 6 and a housing 7. It should be noted that in the following explanation, front, rear left, right, up and down directions are defined as meaning the front, rear, left, right, up and down directions of the outboard motor 1, respectively.

The engine 2 generates a thrust for propelling a watercraft. The engine 2 is disposed inside the engine cowl 6. The engine 2 includes a crankshaft 8. The crankshaft 8 extends in a vertical direction. The driveshaft 3 is connected to the crankshaft 8. The driveshaft 3 extends in an up-and-down direction. The propeller shaft 4 extends in a direction intersecting with the driveshaft 3. The propeller shaft 4 extends in a back-and-forth direction. The propeller shaft 4 is connected to the driveshaft 3 through the shift mechanism 5. A propeller 20 is connected to the propeller shaft 4.

The housing 7 is disposed directly below the engine cowl 6. The driveshaft 3 is disposed inside an upper part of the housing 7. The propeller shaft 4 and the shift mechanism 5 are disposed inside a lower part of the housing 7. The shift mechanism 5 switches the rotational direction of power to be transmitted from the driveshaft 3 to the propeller shaft 4. The shift mechanism 5 includes, for instance, a plurality of gears and a clutch that changes meshing of the gears.

The outboard motor 1 includes a bracket 60. The outboard motor 1 is attached to a vessel body of the watercraft through the bracket 60. The bracket 60 includes a trim and tilt shaft 61. The trim and tilt shaft 61 extends in a right-and-left direction of the outboard motor 1. The outboard motor 1 is supported by the bracket 60, while being rotatable about the trim and tilt shaft 61.

Figure 2:
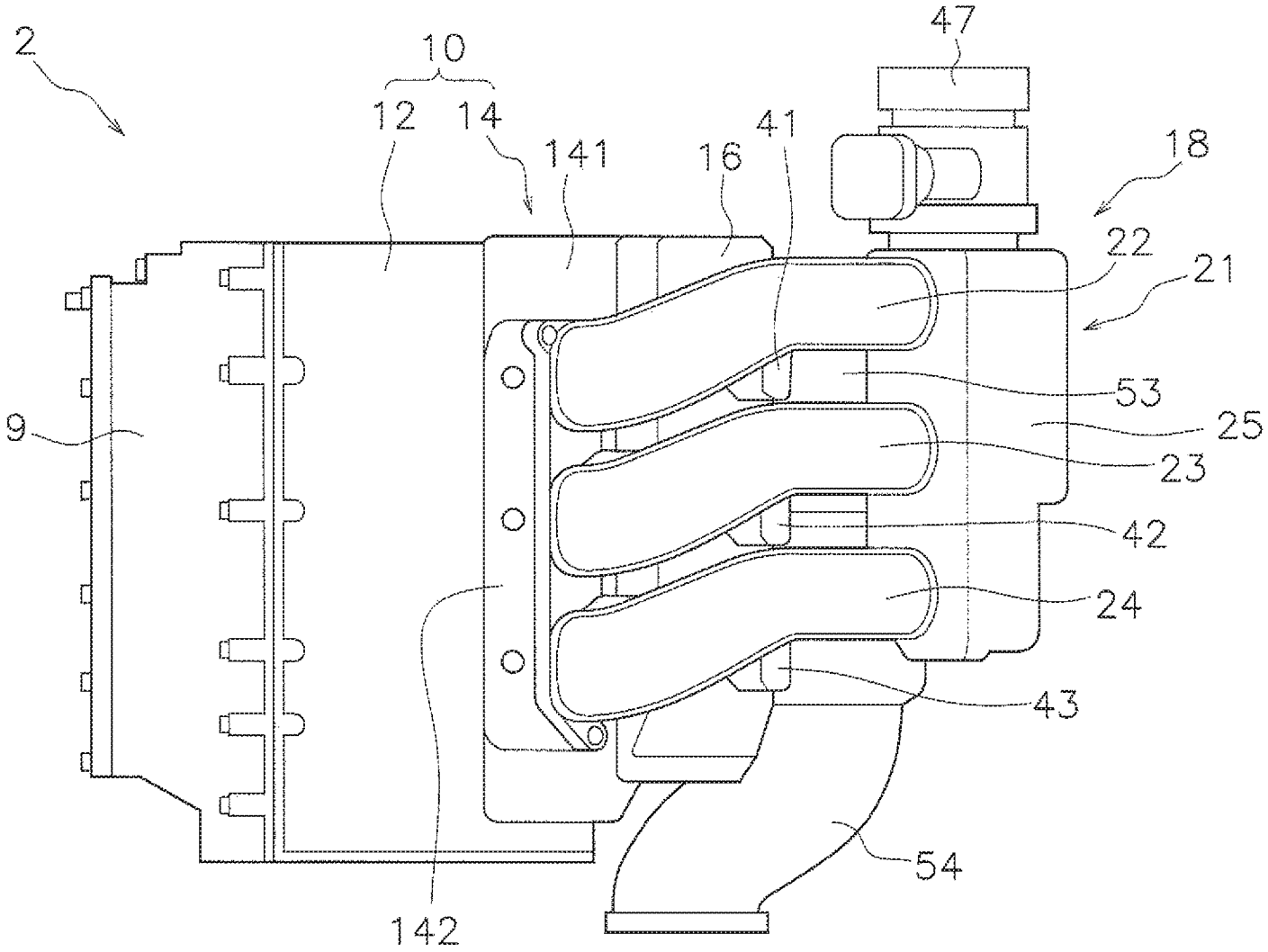
FIG. 2 is a left side elevational view of an engine for the outboard motor illustrated in FIG. 1.
Figure 3:
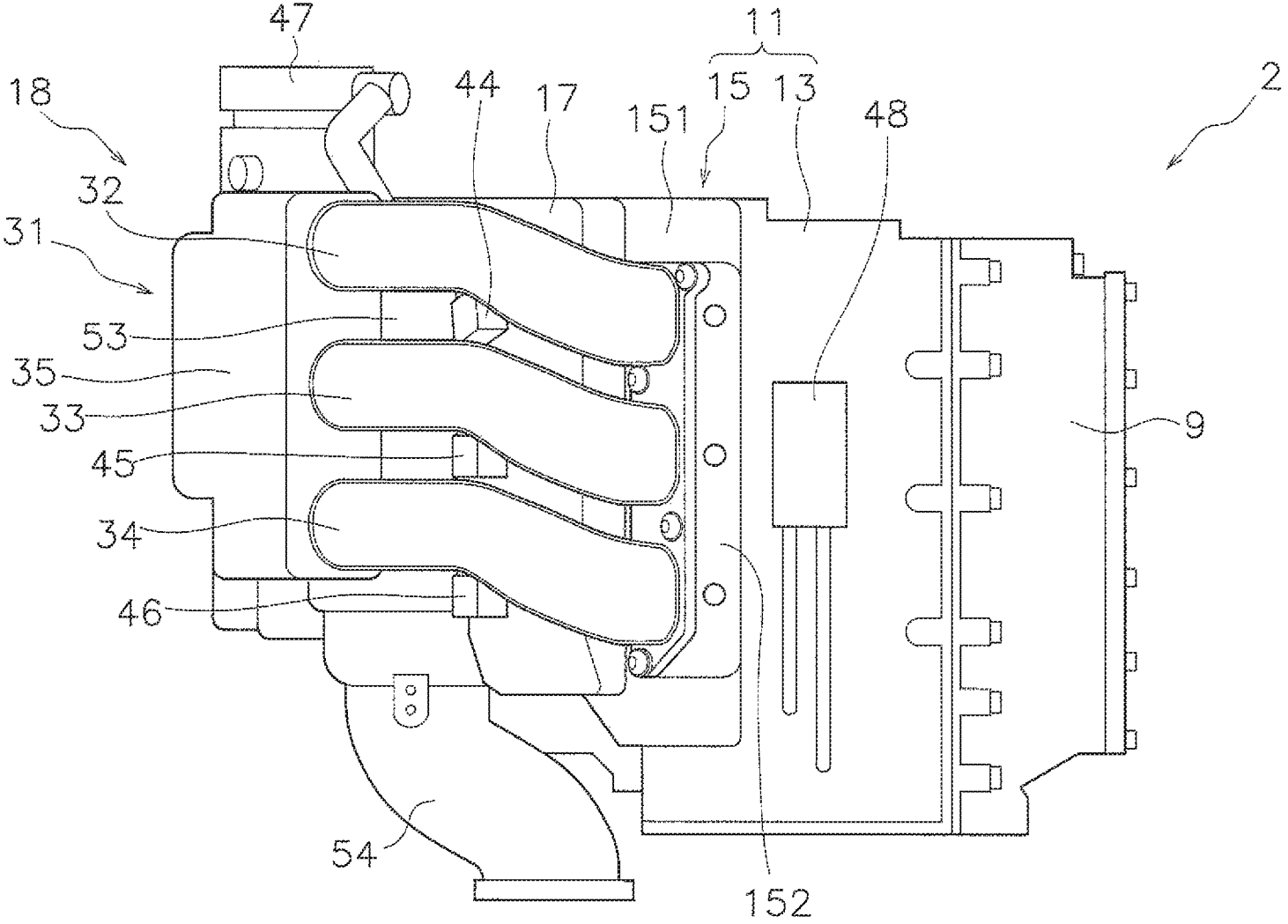
FIG. 3 is a right side elevational view of the engine illustrated in FIG. 2.
Figure 4:
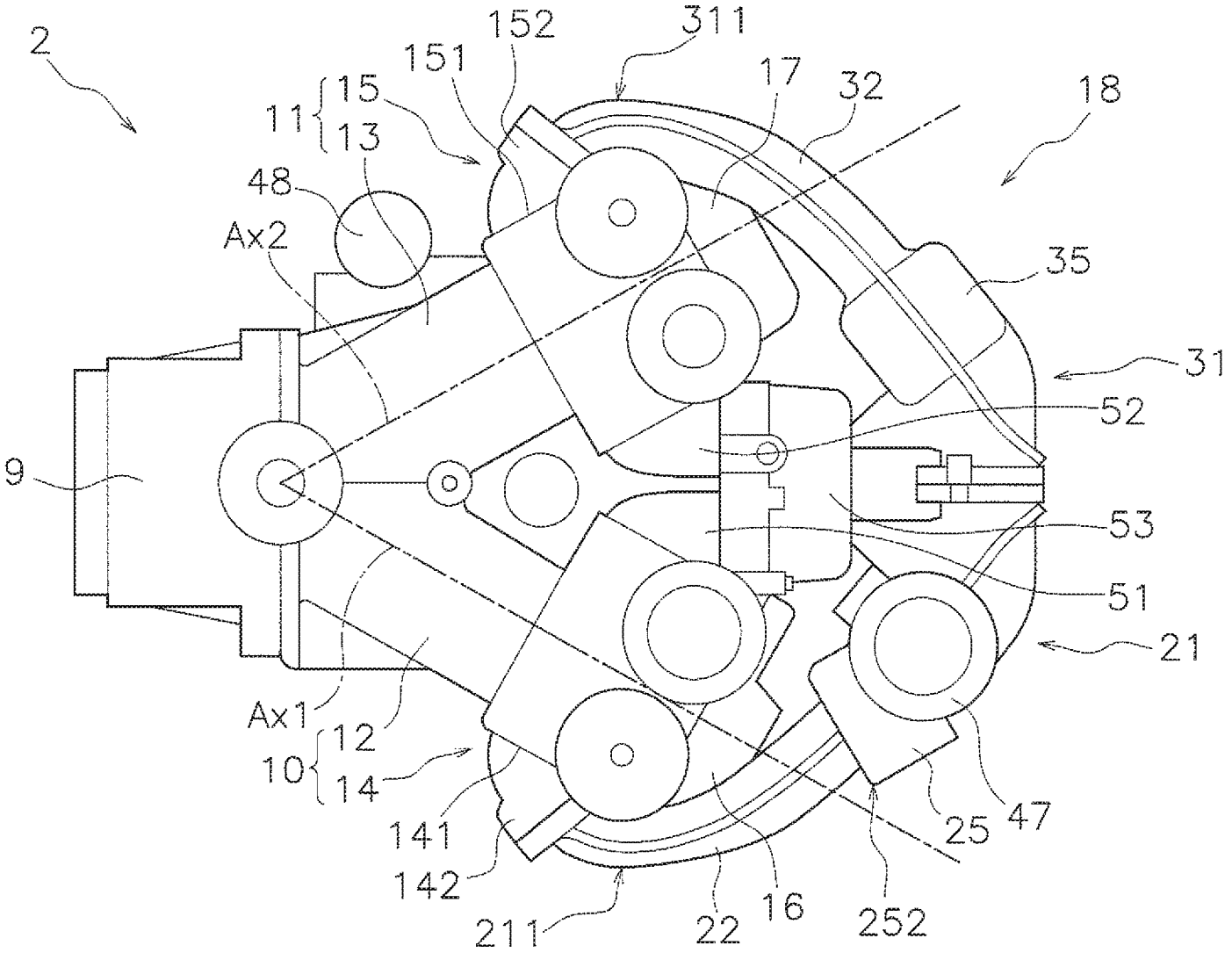
FIG. 4 is a top view of the engine illustrated in FIGS. 2 and 3.
Figure 5:
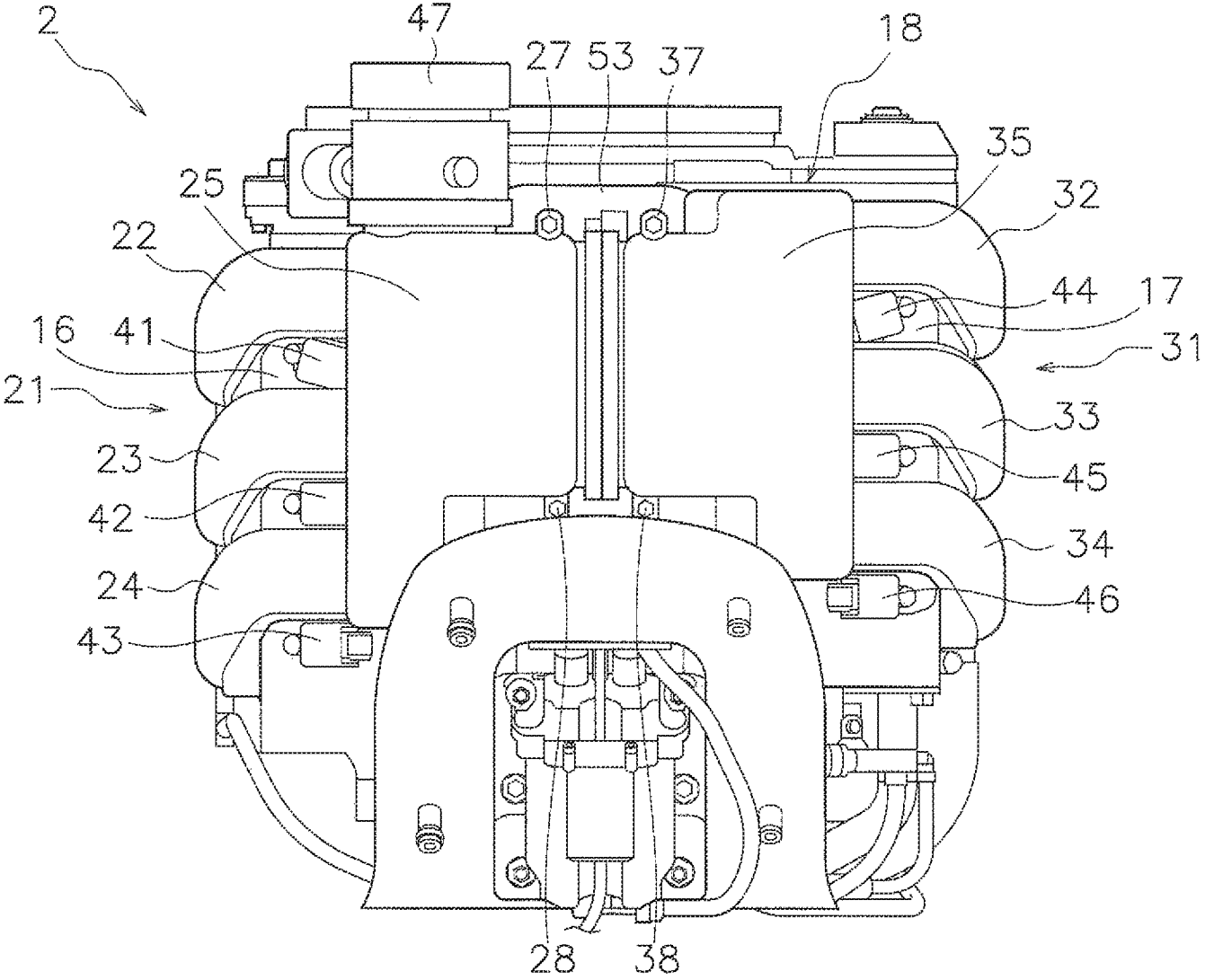
FIG. 5 is a rear view of the engine illustrated in FIGS. 2 to 4.

FIG. 2 is a left side elevational view of the engine 2 for the outboard motor 1 illustrated in FIG. 1. FIG. 3 is a right side view of the engine 2 illustrated in FIG. 2. FIG. 4 is a top view of the engine 2 illustrated in FIGS. 2 and 3. FIG. 5 is a rear view of the engine 2 illustrated in FIGS. 2 to 4. As shown in FIGS. 2 to 4, the engine 2 includes a crankcase 9, a left cylinder 10, a right cylinder 11, a left head cover 16 and a right head cover 17. The crankcase 9 accommodates at least part of the crankshaft 8 described above.

The left and right cylinders 10 and 11 are disposed behind the crankcase 9. The left and right cylinders 10 and 11 are disposed in left and right alignment. The left and right cylinders 10 and 11 are disposed to tilt with respect to the back-and-forth direction such that an interval therebetween is widened backward. The left cylinder 10 includes a cylinder axis Ax1 extending backward and leftward. The right cylinder 11 includes a cylinder axis Ax2 extending backward and rightward. The engine 2 is a so-called V engine.

The left cylinder 10 includes a left cylinder body 12 and a left cylinder head 14. The right cylinder 11 includes a right cylinder body 13 and a right cylinder head 15. The left and right cylinder bodies 12 and 13 are disposed behind the crankcase 9. The left and right cylinder bodies 12 and 13 are disposed in left and right alignment. The left and right cylinder bodies 12 and 13 are connected to the crankcase 9.

The left cylinder head 14 is disposed behind the left cylinder body 12. The right cylinder head 15 is disposed behind the right cylinder body 13. The left cylinder head 14 is connected to the left cylinder body 12. The right cylinder head 15 is connected to the right cylinder body 13. The left and right cylinder heads 14 and 15 are disposed in left and right alignment. The left and right cylinder heads 14 and 15 are disposed to tilt with respect to the back-and-forth direction such that an interval therebetween is widened backward.

It should be noted that the left and right cylinder bodies 12 and 13 can be separated from the crankcase 9, or alternatively, can be integrated with the crankcase 9. The left cylinder body 12 can he separated from the left cylinder head 14, or alternatively, can be integrated with the left cylinder head 14. The right cylinder body 13 can be separated from the right cylinder head 15, or alternatively, can be integrated with the right cylinder head 15. The left and right cylinder bodies 12 and 13 can be integrated with each other, or alternatively, can be separated from each other.

The left head cover 16 is disposed behind the left cylinder head 14. The left head cover 16 is attached to the left cylinder head 14. The right head cover 17 is disposed behind the right cylinder head 15. The right head cover 17 is attached to the right cylinder head 15.

Figure 6:
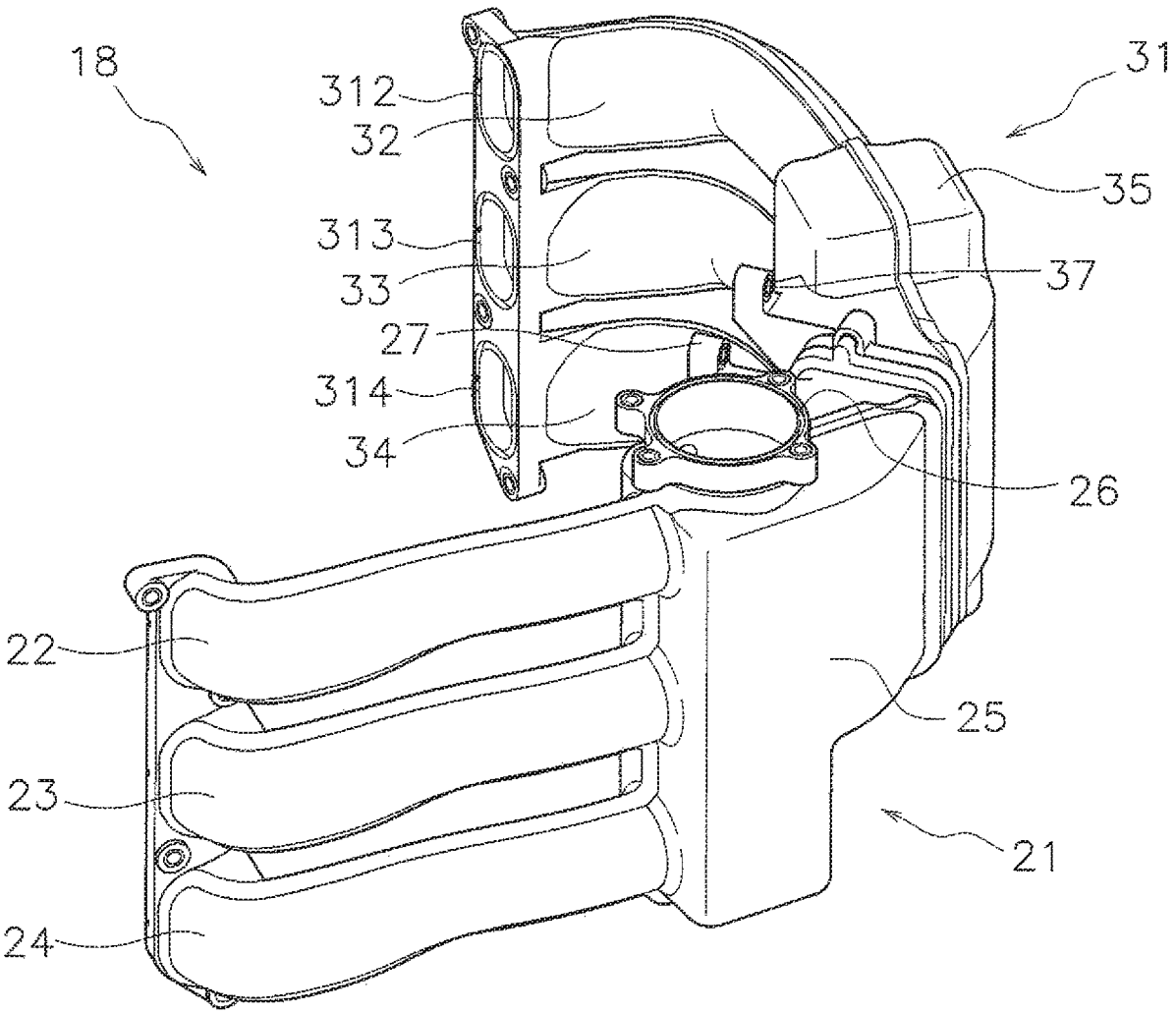
FIG. 6 is a perspective view of an intake manifold for the engine illustrated in FIGS. 2 to 5.

The outboard motor 1 includes an intake manifold 18. FIG. 6 is a perspective view of the intake manifold 18. As shown in FIGS. 2 to 6, the intake manifold 18 is connected to the left and right cylinder heads 14 and 15. The intake manifold 18 is disposed behind the left and right cylinder heads 14 and 15. The intake manifold 18 includes a left intake manifold 21 and a right intake manifold 31. The left and right intake manifolds 21 and 31 are separated from each other. However, the left and right intake manifolds 21 and 31 can be integrated with each other.

The left intake manifold 21 is attached to the left cylinder head 14. The left intake manifold 21 is connected to an outer lateral surface 141 of the left cylinder head 14. The outer lateral surface 141 of the left cylinder head 14 is the left lateral surface of the left cylinder head 14. Specifically, the left cylinder head 14 is provided with a left intake port 142 on the outer lateral surface 141. The left intake port 142 protrudes laterally outward from the outer lateral surface 141 of the left cylinder head 14. The left intake port 142 is shaped to curve backward from the outer lateral surface 141 of the left cylinder head 14.

The left intake manifold 21 extends backward through the left side of the left cylinder head 14. The left intake manifold 21 is disposed backward of the crankcase 9. As seen in a side view, the left intake manifold 21 does not overlap with the crankcase 9. The left intake manifold 21 is disposed backward of the left cylinder body 12. As seen in the side view, the left intake manifold 21 does not overlap with the left cylinder body 12.

The right intake manifold 31 is attached to the right cylinder head 15. The right intake manifold 31 is connected to an outer lateral surface 151 of the right cylinder head 15. The outer lateral surface 151 of the right cylinder head 15 is the right lateral surface of the right cylinder head 15. Specifically, the right cylinder head 15 is provided with a right intake port 152 on the outer lateral surface 151 thereof. The right intake port 152 protrudes laterally outward from the outer lateral surface 151 of the right cylinder head 15. The right intake port 152 is shaped to curve backward from the outer lateral surface 151 of the right cylinder head 15.

The right intake manifold 31 extends backward through the right side of the right cylinder head 15. The right intake manifold 31 is disposed backward of the crankcase 9. As seen in a side view, the right intake manifold 31 does not overlap with the crankcase 9. The right intake manifold 31 is disposed backward of the right cylinder body 13. As seen in the side view, the right intake manifold 31 does not overlap with the right cylinder body 13.

Figure 7:
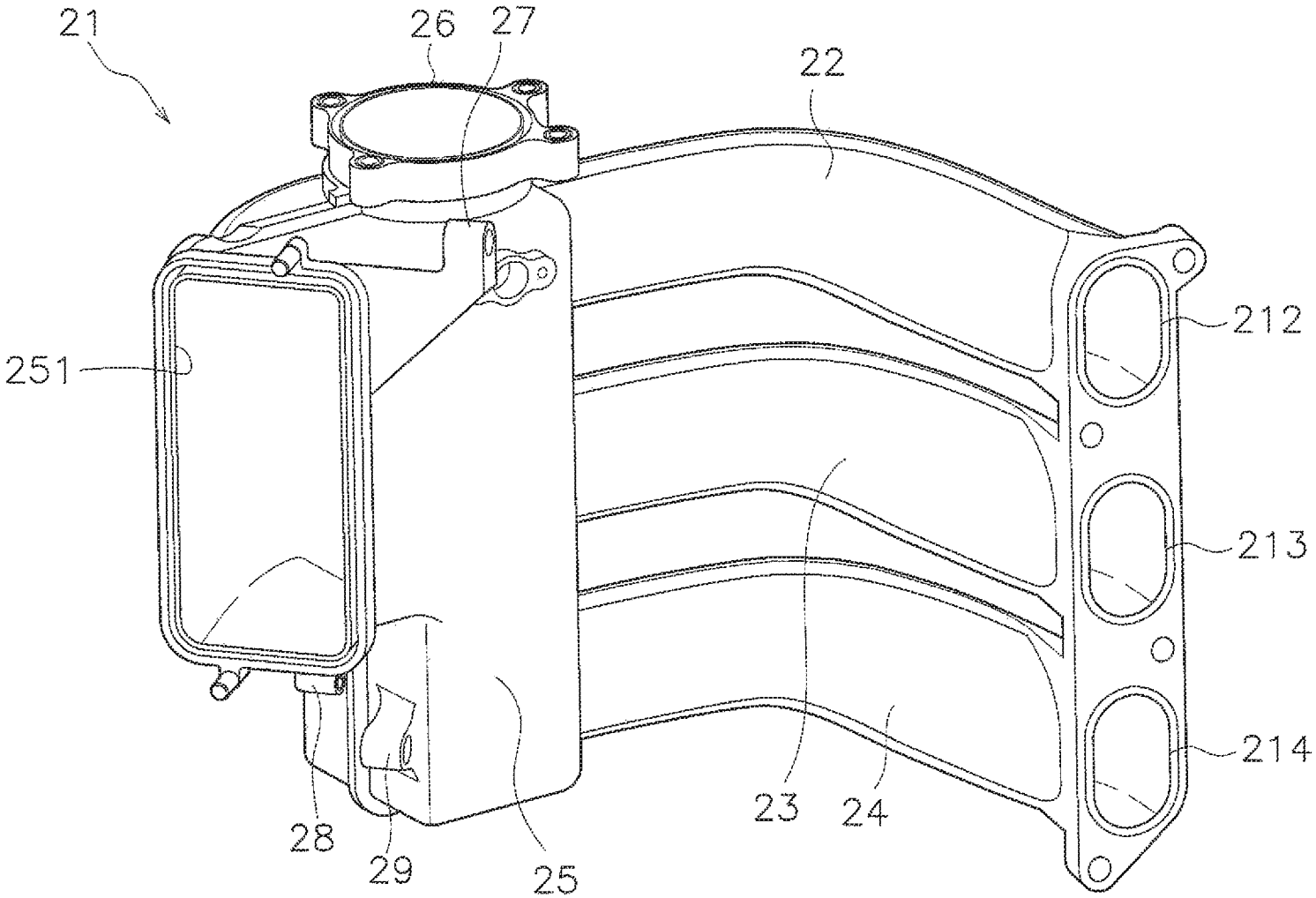
FIG. 7 is a perspective view of a left intake manifold of the intake manifold illustrated in FIG. 6.

FIG. 7 is a perspective view of the left intake manifold 21. As shown in FIG. 7, the left intake manifold 21 includes a plurality of left intake pipes 22 to 24 and a left pipe merge collector 25. The left intake pipes 22 to 24 are disposed in alignment in the up-and-down direction. As shown in FIG. 2, the left intake pipes 22 to 24 are connected to the outer lateral surface 141 of the left cylinder head 14. The left intake pipes 22 to 24 extend backward from the left cylinder head 14. As shown in FIG. 4, the left intake pipes 22 to 24 are shaped to extend through the left side of the left cylinder head 14 and then carve laterally inward in a position behind the left head cover 16.

The left intake pipe 22 includes a left connection port 212. The left intake pipe 23 includes a left connection port 213. The left intake pipe 24 includes a left connection port 214. The left connection ports 212 to 214 are connected to the left intake port 142. The left connection ports 212 to 214 are integrated with each other. However, the left connection ports 212 to 214 can be separated from each other.

As seen in the rear view shown in FIG. 5, the left intake pipes 22 to 24 overlap with the left head cover 16. The left intake pipes 22 to 24 are disposed at intervals in the up-and-down direction. As seen in the rear view, ignition coils 41 to 43 are disposed in alternate alignment with the left intake pipes 22 to 24. It should be noted that in the present embodiment, the left intake manifold 21 includes three left intake pipes 22 to 24. However, the number of the left intake pipes 22 to 24 is not limited to three, and alternatively, can be less than or greater than three.

The left pipe merge collector 25 is connected to the left intake pipes 22 to 24. The left pipe merge collector 25 extends in the up-and-down direction. The left pipe merge collector 25 is disposed behind the left head cover 16. As seen in the rear view, the left pipe merge collector 25 overlaps with the left head cover 16. The left intake pipes 22 to 24 are connected to the left lateral surface of the left pipe merge collector 25. The left pipe merge collector 25 includes a left connection opening 251. The left connection opening 251 is provided in the right lateral surface of the left pipe merge collector 25.

Figure 8:
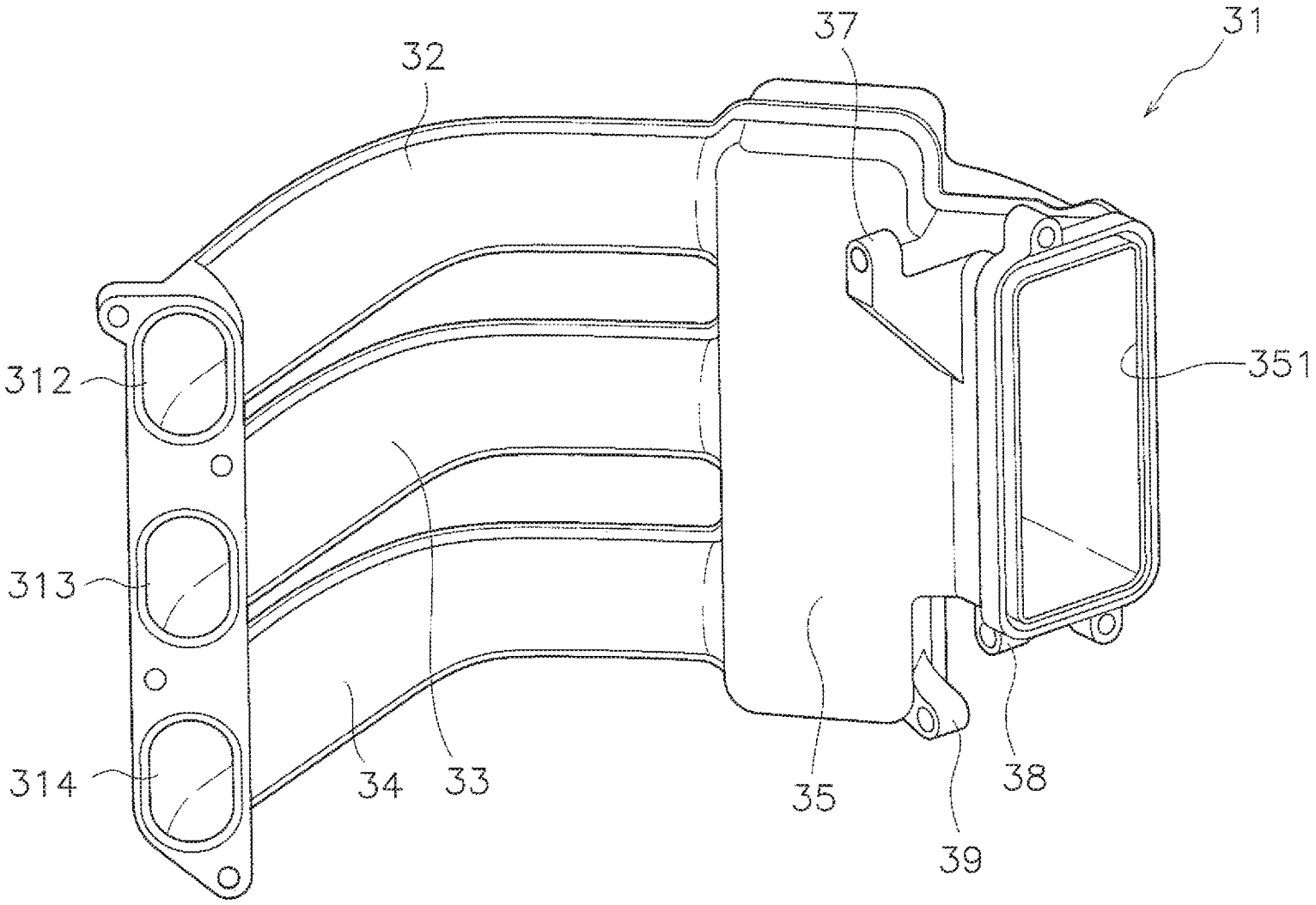
FIG. 8 is a perspective view of a right intake manifold of the intake manifold illustrated in FIG. 6.

FIG. 8 is a perspective view of the right intake manifold 31. As shown in FIG. 8, the right intake manifold 31 includes a plurality of right intake pipes 32 to 34 and a right pipe merge collector 35. The right intake pipes 32 to 34 are disposed in alignment in the up-and-down direction. As shown in FIG, 3, the right intake pipes 32 to 34 are connected to the outer lateral surface 151 of the right cylinder head 15. The right intake pipes 32 to 34 extend backward from the right cylinder head 15. As shown in FIG. 4, the right intake pipes 32 to 34 are shaped to extend through the right side of the right cylinder head 15 and then curve laterally inward in a position behind the right head cover 17.

The right intake pipe 32 includes a right connection port 312. The right intake pipe 33 includes a right connection port 313. The right intake pipe 34 includes a right connection port 314. The right connection ports 312 to 314 are connected to the right intake port 152. The right connection ports 312 to 314 are integrated with each other. However, the right connection ports 312 to 314 can be separated from each other.

As seen in the rear view shown in FIG. 5, the right intake pipes 32 to 34 overlap with the right head cover 17. The right intake pipes 32 to 34 are disposed at intervals in the up-and-down direction. As seen in the rear view, ignition coils 44 to 46 are disposed in alternate alignment with the right intake pipes 32 to 34. It should be noted that in the present embodiment, the right intake manifold 31 includes three right intake pipes 32 to 34. However, the number of the right intake pipes 32 to 34 is not limited to three, and alternatively, can be less than or greater than three.

The right pipe merge collector 35 is connected to the right intake pipes 32 to 34. The right pipe merge collector 35 extends in the up-and-down direction. The right pipe merge collector 35 is disposed behind the right head cover 17. As seen in the rear view, the right pipe merge collector 35 overlaps with the right head cover 17. The right intake pipes 32 to 34 are connected to the right lateral surface of the right pipe merge collector 35. The right pipe merge collector 35 includes a right connection opening 351. The right connection opening 351 is provided in the left lateral surface of the right pipe merge collector 35.

The left and right connection openings 251 and 351 are connected to each other. The left and right connection openings 251 and 351 are disposed behind a V-shaped space produced between the left and right cylinder heads 14 and 15. In other words, the left and right intake manifolds 21 and 31 are connected to each other in a position behind the V-shaped space produced between the left and right cylinder heads 14 and 15.

As shown in FIG. 4, the outboard motor 1 includes a plurality of left exhaust pipes 51, a plurality of right exhaust pipes 52 and an exhaust pipe 53. It should be noted that FIG. 4 only shows the uppermost one of the left exhaust pipes 51 and that of the right exhaust pipes 52. The left exhaust pipes 51 and the right exhaust pipes 52 are disposed in the V-shaped space produced between the left and right cylinder heads 14 and 15. The left exhaust pipes 51 are connected to the inner lateral surface of the left cylinder head 14, and extends backward from the left cylinder head 14. The right exhaust pipes 52 are connected to the inner lateral surface of the right cylinder head 15, and extends backward from the right cylinder head 15.

The exhaust pipe 53 contains a catalyst such as a three-way catalyst, and purifies exhaust gas transferred thereto from the engine 2. The exhaust pipe 53 extends in the up-and-down direction. The exhaust pipe 53 is connected to the left exhaust pipes 51 and the right exhaust pipes 52. The exhaust pipe 53 is disposed behind the left exhaust pipes 51 and the right exhaust pipes 52. The exhaust pipe 53 is disposed in front of the left pipe merge collector 25 of the left intake manifold 21 and the right pipe merge collector 35 of the right intake manifold 31. The exhaust pipe 53 is disposed in the V-shaped space produced between the left and right cylinder heads 14 and 15. As seen in the rear view, the exhaust pipe 53 overlaps with the left pipe merge collector 25 of the left intake manifold 21 and the right pipe merge collector 35 of the right intake manifold 31. An exhaust pipe 54 is connected to a lower part of the exhaust pipe 53. The exhaust pipe 54 extends downward from the exhaust pipe 53.

As shown in FIG. 7, the left intake manifold 21 includes a plurality of left fixation portions 27 to 29. The left intake manifold 21 is fixed at the left fixation portions 27 to 29 to the exhaust pipe 53. The left fixation portions 27 to 29 are provided on the left pipe merge collector 25. As shown in FIG. 8, the right intake manifold 31 includes a plurality of right fixation portions 37 to 39. The right intake manifold 31 is fixed at the right fixation portions 37 to 39 to the exhaust pipe 53. The right fixation portions 37 to 39 are provided on the right pipe mere collector 35.

The outboard motor 1 includes a throttle body 47. The throttle body 47 is attached to the intake manifold 18. The throttle body 47 is attached to the left intake manifold 21. The throttle body 47 regulates the amount of air to be supplied to the intake manifold 18. As shown in FIG. 6, the left intake manifold 21 includes an attachment portion 26 of the intake manifold 18. The attachment portion 26 is provided on the left pipe merge collector 25 of the left intake manifold 21. Specifically, the attachment portion 26 is provided on the upper surface of the left pipe merge collector 25. The attachment portion 26 is opened upward. The throttle body 47 is attached to the attachment portion 26.

As shown in FIG. 4, the throttle body 47 is disposed inward of the left lateral end 211 of the left intake manifold 21 in the right-and-left direction. The throttle body 47 is disposed inward of a left lateral end 252 of the left pipe merge collector 25 in the right-and-left direction. The throttle body 47 is disposed directly above the left intake manifold 21. As seen in the plan view, the throttle body 47 at least in part overlaps with the left intake manifold 21. As seen in the plan view, the throttle body 47 at least in part overlaps with the left pipe merge collector 25.

As seen in the plan view, the throttle body 47 is disposed backward of the left and right head covers 16 and 17. The throttle body 47 is disposed between the left lateral end 211 of the left intake manifold 21 and the right lateral end 311 of the right intake manifold 31 in the right-and-left direction. As seen in the plan view, the throttle body 47 is disposed between an extension of the cylinder axis Ax1 of the left cylinder head 14 and that of the cylinder axis Ax2 of the right cylinder head 15.

The outboard motor 1 includes an oil filter 48. The oil filter 48 is disposed outside the right lateral surface of the right cylinder body 13 in the right-and-left direction. The oil filter 48 is disposed forward of the right intake manifold 31. As seen in the side view, the oil filter 48 does not overlap with the right intake manifold 31.

In the outboard motor 1 according to the present embodiment explained above, the left intake manifold 21 extends backward from the left cylinder head 14, and the throttle body 47 is disposed backward of the left head cover 16. Because of this, the outboard motor 1 can be made more compact in size of the front part there of than when the throttle body 47 is disposed in front of the engine 2. Consequently, it is possible to prevent interference between the front part of the outboard motor 1 and the vessel body of the watercraft in tilting up the outboard motor 1. Furthermore, the outboard motor 1 is not required to be set off (displaced) backward so as to prevent interference between the front part thereof and the vessel body of the watercraft. Hence, increase in weight of the outboard motor 1 can be inhibited.

Figure 9:
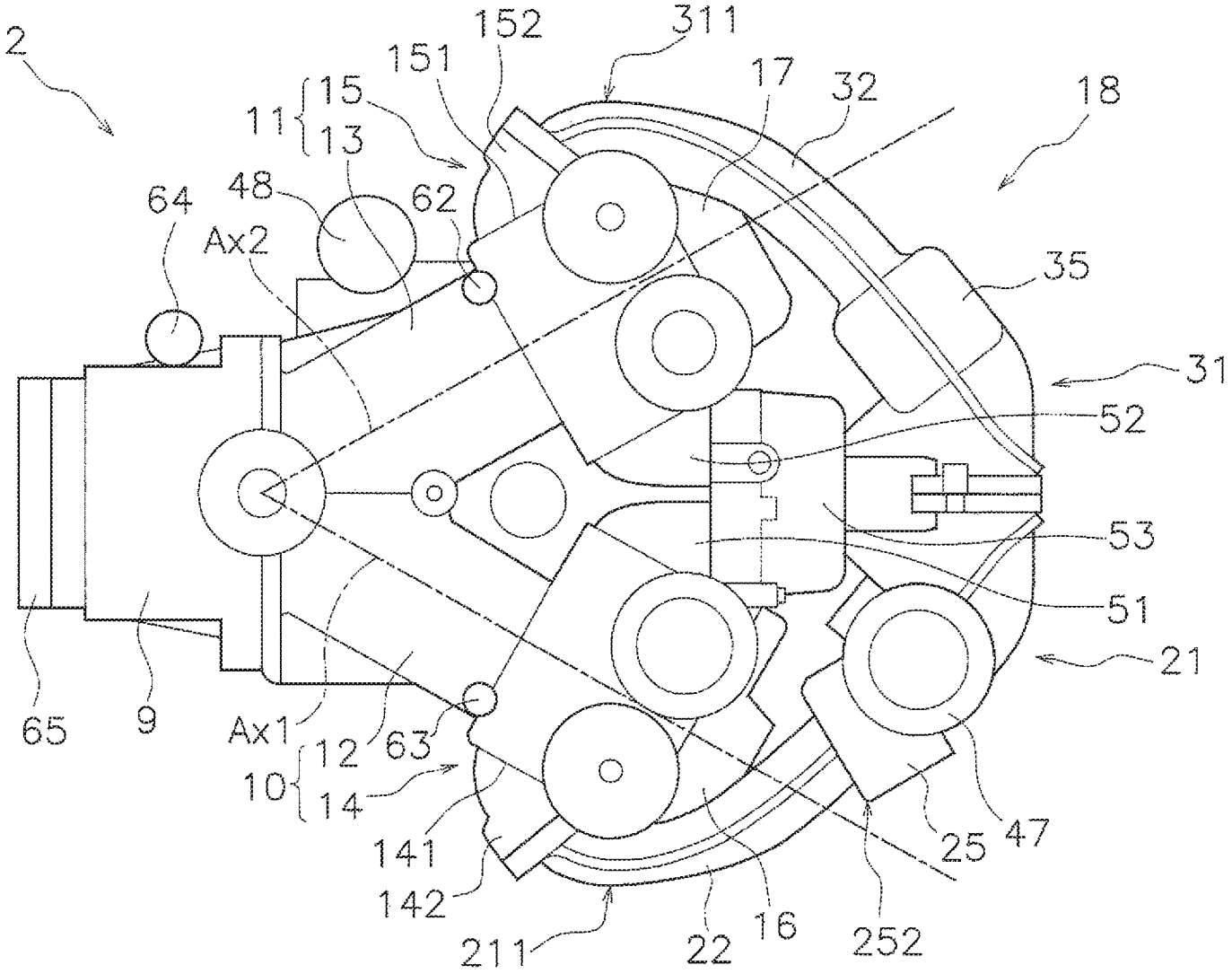
FIG. 9 is a top view of an engine according to another embodiment.

As seen in the side view, the crankcase 9 does not overlap with the tell and right intake manifolds 21 and 31. Because of this, access to the crankcase 9 is made easier. Additionally, as seen in the side view, a component (or components) attached to the engine 2, such as the oil filter 48, does not overlap with the left and right intake manifolds 21 and 31 as well. Because of this, access to the component (or components) attached to the engine 2 is made easier. Consequently, the engine 2 can be enhanced in maintenance performance. It should be noted that the component (or components) attached to the engine 2 is not limited to the oil filter 48, and can be other component (or components). For example, as shown in FIG. 9, the components attached to the engine 2 can include, not only the oil filter 48 described above, but also periodic replacement components such as thermostats 62 and 63. Furthermore or alternatively, the components attached to the engine 2 can include auxiliary devices for the engine 2 such as a starter motor 64 and a rectifier/regulator 65.

One embodiment of the present invention has been explained above. However, the present invention is not limited to the aforementioned embodiment, and a variety of changes can be made without departing from the gist of the present invention.

The configuration of the outboard motor 1 is not limited to that of the aforementioned embodiment, and can be changed. The configuration of the engine 2 is not limited to that of the aforementioned embodiment, and can be changed. For example, the engine is not limited to the V engine, and can be another type of engine such as an inline engine. In this case, either the left intake manifold 21 or the right intake manifold 31 can be omitted.

The layout of the throttle body 47 is not limited to that of the aforementioned embodiment, and can be changed. For example, the throttle body 47 can be attached to the right intake manifold 31. The position, to which the throttle body 47 is attached, is not limited to the upper surface of the intake manifold 18, and can be any other suitable position.

What is claimed is:

1. An outboard motor comprising:

an engine including a crankcase, a crankshaft at least in part disposed inside the crankcase, a cylinder disposed behind the crankcase, and a head cover disposed behind the cylinder;

a driveshaft connected to the crankshaft, the driveshaft extending in an up-and-down direction of the outboard motor;

a propeller shaft connected to the driveshaft, the propeller shaft extending in a back-and-forth direction of the outboard motor;

an intake manifold connected to the cylinder, the intake manifold extending backward from the cylinder; and a throttle body attached to the intake manifold, the throttle body being disposed backward of the head cover as seen in a plan view of the outboard motor, the throttle body being disposed inward of a lateral end of the intake manifold in a right-and-left direction of the outboard motor.

2. The outboard motor according to claim 1, wherein the throttle body is disposed above the intake manifold, and the throttle body at least in part overlaps with the intake manifold as seen in the plan view of the outboard motor.

3. The outboard motor according to claim 1, wherein the intake manifold includes a plurality of intake pipes extending backward from the cylinder the intake pipes being disposed in alignment in the up-and-down direction of the outboard motor, and a pipe merge collector connected to the intake pipes, the pipe merge collector extending in the up-and-down direction of the outboard motor, and the throttle body is attached to the pipe merge collector.

4. The outboard motor according to claim 1, further comprising:

a component disposed laterally to the cylinder and forward of the intake manifold as seen in the plan view of the outboard motor.

5. The outboard motor according to claim 1, wherein the cylinder includes a left cylinder including a cylinder axis extending backward and leftward, and a right cylinder including a cylinder axis extending backward and rightward, the head cover includes a left head cover attached to the left cylinder, and a right head cover attached to the right cylinder, the intake manifold includes a left intake manifold attached to the left cylinder, and a right intake manifold attached to the right cylinder, and the throttle body is disposed backward of the left head cover and the right head cover as seen in the plan view of the outboard motor, and, the throttle body is disposed between a left lateral end of the left intake manifold and a right lateral end of the tight intake manifold in the right-and-left direction of the outboard motor.

6. The outboard motor according to claim 5, wherein the throttle body is disposed between an extension of the cylinder axis of the left cylinder and an extension of the cylinder axis of the right cylinder as seen in the plan view of the outboard motor.

7. The outboard motor according to claim 5, wherein the left intake manifold is connected to a left lateral surface of the left cylinder, the left intake manifold extending backward through a left side of the left cylinder, and the right intake manifold is connected to a right lateral surface of the right cylinder, the right intake manifold extending backward through a right side of the right cylinder.

* * * * *